US012599238B2

(12) United States Patent
Kang et al.

(10) Patent No.: US 12,599,238 B2
(45) Date of Patent: Apr. 14, 2026

(54) NECK SUPPORTING DEVICE

(71) Applicant: Hyundai Transys Inc., Seosan-si (KR)

(72) Inventors: Gu Chang Kang, Hwaseong-si (KR); Seong Yun Yeo, Incheon (KR); Hyun Seok Song, Hwaseong-si (KR); Ui Jeong Lee, Hwaseong-si (KR)

(73) Assignee: Hyundai Transys Inc., Seosan-si (KR)

( * ) Notice: Subject to any disclaimer, the term of this patent is extended or adjusted under 35 U.S.C. 154(b) by 127 days.

(21) Appl. No.: 18/649,089

(22) Filed: Apr. 29, 2024

(65) Prior Publication Data

US 2024/0374037 A1 Nov. 14, 2024

(30) Foreign Application Priority Data

May 9, 2023 (KR) ..... 10-2023-0059661

(51) Int. Cl.
*A47C 7/38* (2006.01)

(52) U.S. Cl.
CPC ..... *A47C 7/383* (2013.01)

(58) Field of Classification Search
CPC ..... A47C 7/383; B60B 2/882
See application file for complete search history.

(56) References Cited

U.S. PATENT DOCUMENTS 136,531 A * 3/1873 Mitchell ..... B60N 2/882 297/398

FOREIGN PATENT DOCUMENTS

| | | | |
|---|---|---|---|
| KR | 10-1736831 | B1 | 5/2017 |
| KR | 10-2020-0038219 | A | 4/2020 |
| KR | 10-2023-0017731 | A | 2/2023 |

* cited by examiner

*Primary Examiner* — Nicholas McFall
(74) *Attorney, Agent, or Firm* — Bridgeway IP Law Group, PLLC; Jihun Kim

(57) ABSTRACT

Provided is a neck supporting device including a housing capable of being attached to or detached from a seat, a main body capable of being withdrawn from the inside of the housing, the main body including two support portions disposed at two opposite sides of one surface of the main body, respectively, and configured to protrude toward a neck of an occupant, and a strap coupled to the two opposite support portions of the main body while having tension and having a neck support portion positioned between the two opposite support portions and configured to support the neck of the occupant.

11 Claims, 6 Drawing Sheets

NECK SUPPORTING DEVICE

CROSS-REFERENCE TO RELATED APPLICATIONS

This application claims priority to and the benefit of Korean Patent Application No. 10-2023-0059661 filed in the Korean Intellectual Property Office on May 9, 2023, the entire contents of which are incorporated herein by reference.

TECHNICAL FIELD

The present invention relates to a neck supporting device capable of being attached to or detached from a vehicle seat.

BACKGROUND ART

In general, a vehicle seat may include a seat cushion in which an occupant is seated, a seatback on which the occupant's back is supported, and a headrest configured to support the occupant's neck and head.

The headrest serves to support the head of the occupant seated in the vehicle seat. In the event of a vehicle accident or sudden braking of a vehicle, the headrest may support the head to prevent the neck from being instantaneously bent rearward, thereby preventing an injury to cervical vertebrae.

A driver may drive comfortably with his/her head supported on the headrest. A height of the headrest may be adjusted to fit the head of the occupant seated in the vehicle seat. The headrest may be integrated with the seat or configured to be attached to or detached from the seat.

However, because the headrest in the related art protrudes at ordinary times, a position of the headrest cannot be changed depending on the circumstances, which causes a concern that the neck is injured in the event of a vehicle accident or sudden braking of the vehicle. Further, the headrest in the related art may slide upward or downward to adjust the height to fit the head of the occupant seated in the vehicle seat. However, the headrest cannot support a neck part.

DOCUMENT OF RELATED ART

Patent Document (Patent Document 1) Korean Patent No. 10-1736831 (published on May 18, 2017)

SUMMARY OF THE INVENTION

The present invention has been made in an effort to solve the above-mentioned problem, and an object of the present invention is to provide a neck supporting device capable of being attached to a neck part of a vehicle seat and supporting a neck of an occupant seated in the vehicle seat.

In order to achieve the above-mentioned object, the present invention provides a neck supporting device including: a housing capable of being attached to or detached from a seat; a main body capable of being withdrawn from the inside of the housing, the main body including support portions provided at two opposite sides of one surface of the main body and protruding toward a neck of an occupant; and a strap supported by the two opposite support portions of the main body while having tension and having a neck support portion positioned between the two opposite support portions and configured to support the neck of the occupant.

In addition, an opening portion, through which the neck support portion of the strap is withdrawn together with the support portions, may be provided in one surface of the housing, and the other surface of the housing is directed toward the seat.

In addition, the strap may be assembled while penetrating side surfaces of the two opposite support portions.

In addition, a withdrawal device may be provided on the other surface of the main body, and the neck support portion of the strap, together with the two opposite support portions of the main body, may be withdrawn through the opening portion from the inside of the housing by a withdrawal operation of the withdrawal device.

In addition, the withdrawal device may include: a ratchet connected to the main body and fixed to the housing; and a stopper having one end directed toward the ratchet and configured to engage with the ratchet.

In addition, the stopper may be connected to a connection member, and the connection member may be connected to the main body.

In addition, the connection member may be connected to the ratchet by a hinge shaft in a state in which an upper portion of the connection member is inserted into the ratchet, such that the connection member is rotatable about the hinge shaft.

In addition, the stopper may be connected to the connection member by an elastic member.

In addition, the elastic member may be a spring.

The neck supporting device of the present invention may be attached to the neck part of the vehicle seat and support the neck of the occupant seated in the vehicle seat.

In addition, the neck supporting device of the present invention may stably support the neck part, thereby maximizing seat performance.

In addition, according to the present invention, the neck of the occupant seated in the vehicle seat may come into contact with the neck support portion of the strap, such that the cervical vertebrae may be naturally stretched.

In addition, the neck supporting device of the present invention may support the neck part, thereby preventing the neck from being instantaneously bent rearward in the direction of a vehicle accident or sudden braking of the vehicle, thereby preventing an injury to the cervical vertebrae.

The foregoing summary is illustrative only and is not intended to be in any way limiting. In addition to the illustrative aspects, embodiments, and features described above, further aspects, embodiments, and features will become apparent by reference to the drawings and the following detailed description.

Figure 1:
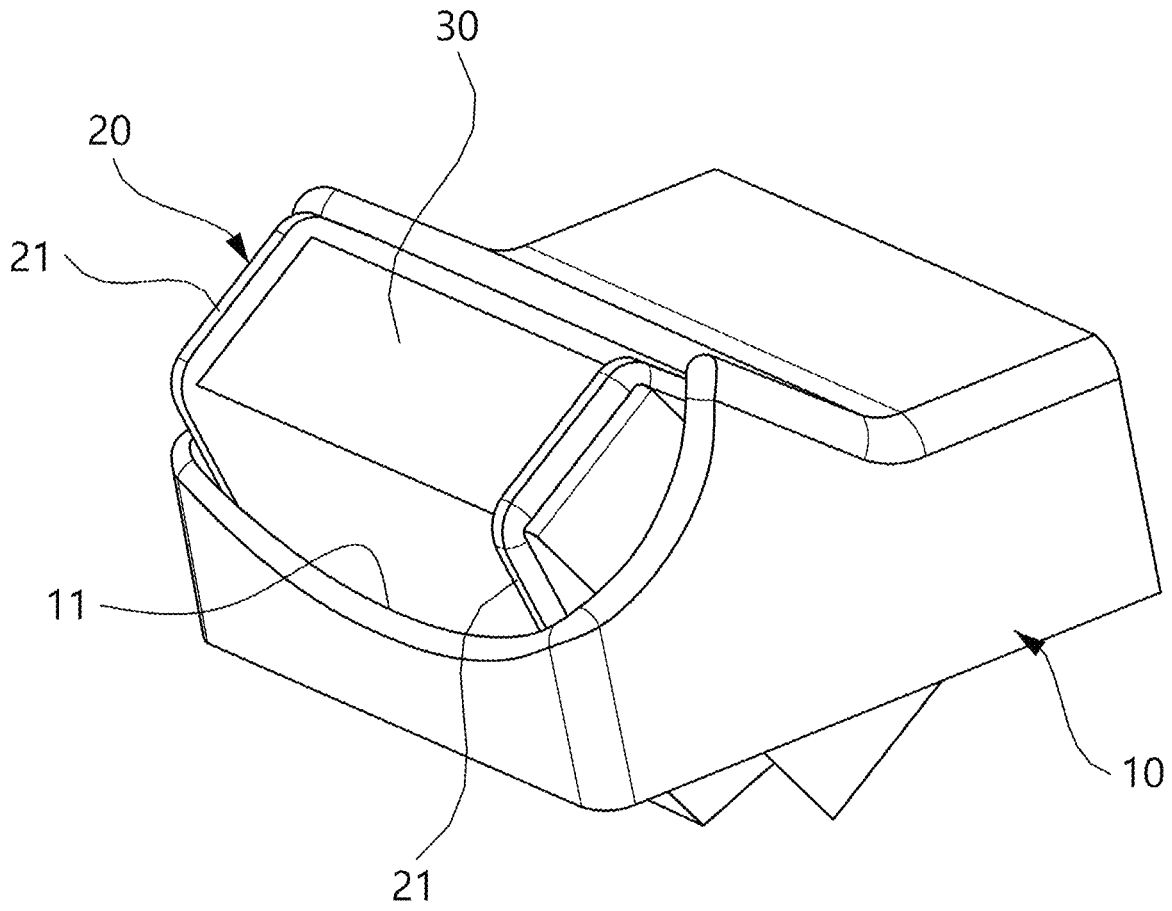
FIG. 1 is a perspective view of a neck supporting device according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter, exemplary embodiments of the present invention will be described in detail with reference to the accompanying drawings. First, in assigning reference numerals to constituent elements of the respective drawings, it should be noted that the same constituent elements will be designated by the same reference numerals, if possible, even though the constituent elements are illustrated in different drawings. In addition, in the description of the present invention, the specific descriptions of publicly known related configurations or functions will be omitted when it is determined that the specific descriptions may obscure the subject matter of the present invention. Further, the exemplary embodiments of the present invention will be described below, but the technical spirit of the present invention is not limited thereto and may of course be modified and variously carried out by those skilled in the art.

Figure 2:
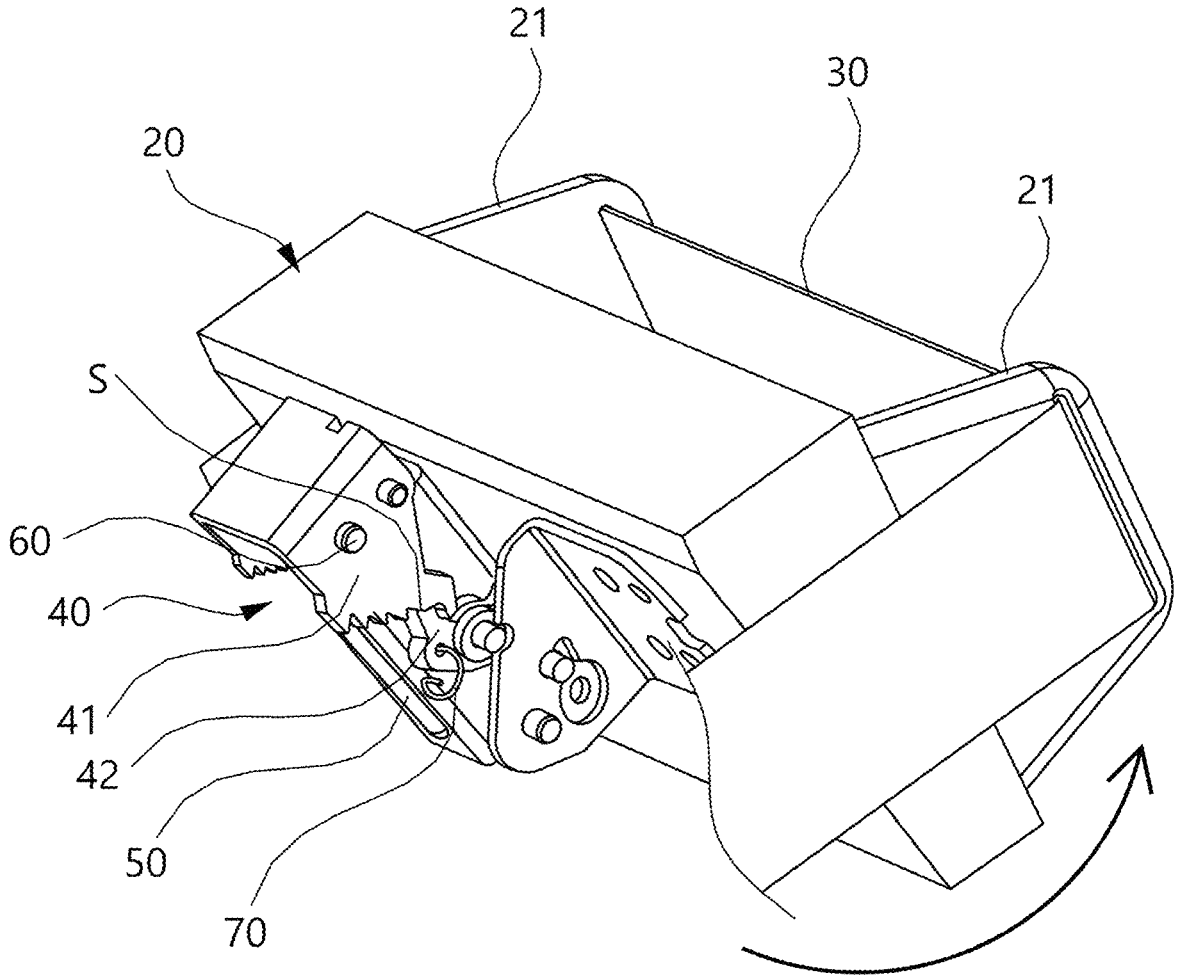
FIG. 2 is a view illustrating a withdrawal operation of a withdrawal device according to the exemplary embodiment of the present invention.
Figure 3:
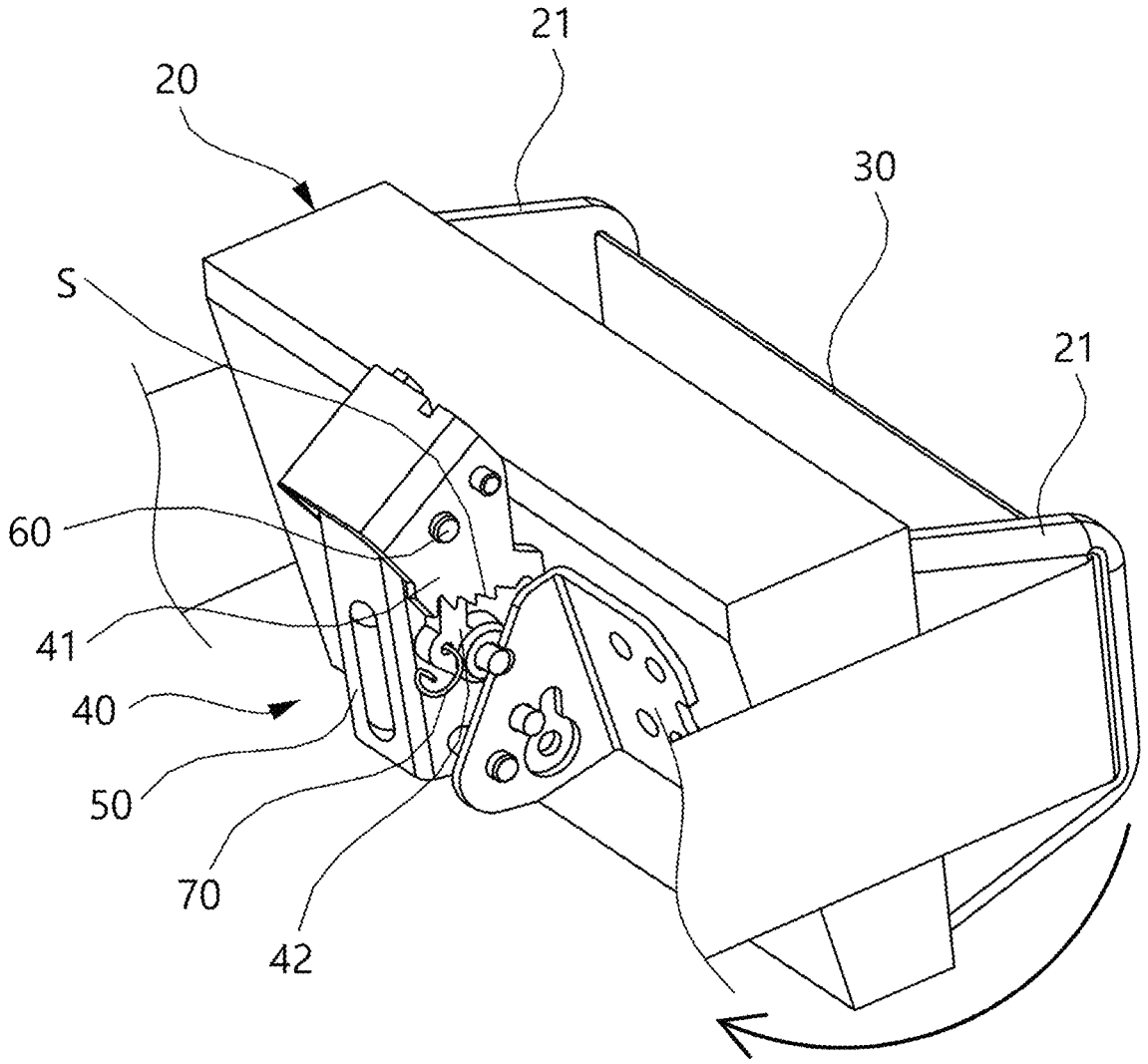
FIG. 3 is a view illustrating a release operation of the withdrawal device according to the exemplary embodiment of the present invention.

FIG. 1 is a perspective view of a neck supporting device according to an exemplary embodiment of the present invention, FIG. 2 is a view illustrating a withdrawal operation of a withdrawal device according to the exemplary embodiment of the present invention, and FIG. 3 is a view illustrating a release operation of the withdrawal device according to the exemplary embodiment of the present invention.

As illustrated in FIGS. 1 to 3, the present invention includes a housing 10, a main body 20 inserted into the housing 10, and a strap 30 connected to the main body 20.

The housing 10 may be attached to or detached from a vehicle seat 80. Specifically, the housing 10 may be attached to be positioned on a neck part between a backseat 81 and a headrest 82 of the seat 80.

An opening portion 11 may be provided in one surface of the housing 10. The opening portion 11 is directed toward the neck part of the occupant seated in the vehicle seat 80. The other surface of the housing 10 is directed toward the seat 80.

For example, the housing 10 may be attached to or detached from the seat 80 by various attachment devices such as a strap, a snap fastener, and a hook-and-loop fastener.

The main body 20 may have support portions 21, and the strap 30 may be coupled to the support portions 21. The support portions 21 may be provided at two opposite left and right sides of one surface of the main body 20. The support portions 21 may protrude from one surface of the main body 20 toward the neck of the occupant seated in the vehicle seat.

The strap 30 may be supported by the two opposite support portions 21 of the main body 20 while having tension. The neck of the occupant seated in the vehicle seat may be supported by a neck support portion of the strap 30 positioned between the two opposite support portions 21 of the main body 20.

Because the strap 30 has tension, the cervical vertebrae may be stretched when the neck of the occupant seated in the vehicle seat comes into contact with the strap 30. Therefore, comfort may be provided to the occupant seated in the vehicle seat.

The neck support portion of the strap 30, together with the support portions 21, may be withdrawn through the opening portion 11 of the housing 10.

The strap 30 may be assembled while penetrating side surfaces of the two opposite support portions 21 of the main body 20.

A withdrawal device 40 may be provided on the other surface of the main body 20. The neck support portion of the strap 30, together with the two opposite support portions 21 of the main body 20, may be withdrawn through the opening portion 11 from the inside of the housing 10 by a withdrawal operation of the withdrawal device 40.

The neck support portion of the strap 30, together with the two opposite support portions 21 of the main body 20, may be inserted into the housing 10 by a release operation of the withdrawal device 40.

The withdrawal device 40 may include a ratchet 41 and a stopper 42 configured to engage(S) with the ratchet 41.

For example, the ratchet 41 may be connected to the main body 20 and fixed to the housing 10. One end of the stopper 42 may engage(S) with the ratchet 41.

The stopper 42 may be connected to a connection member 50. The connection member 50 may be connected to the main body 20. The connection member 50 may be connected to the ratchet 41 by a hinge shaft 60 in a state in which an upper portion of the connection member 50 is inserted into the ratchet 41. The connection member 50 connected to the main body 20 may rotate about the hinge shaft 60.

The stopper 42 may be connected to the connection member 50 by an elastic member 70. The stopper 42 may be elastically supported by the elastic member 70. For example, the elastic member 70 may be a spring.

Next, the withdrawal operation of the withdrawal device according to the present invention will be described.

When the main body 20 is pulled in the arrow direction illustrated in FIG. 2, the connection member 50 connected to the main body 20 may rotate about the hinge shaft 60, such that the stopper 42 may move in a withdrawal direction in the state in which the stopper 42 engages(S) with the ratchet 41.

As the stopper 42 moves in the withdrawal direction in the state in which the stopper 42 engages(S) with the ratchet 41, the neck support portion of the strap 30, together with the support portions 21, may be withdrawn through the opening portion 11 from the inside of the housing 10.

Next, the release operation of the withdrawal device according to the present invention will be described.

When the main body 20 rotates in the arrow direction illustrated in FIG. 3, the connection member 50 connected to the main body 20 rotates about the hinge shaft 60, such that the stopper 42 may move in a release direction in the state in which the stopper 42 engages(S) with the ratchet 41.

As the stopper 42 moves in the release direction in the state in which the stopper 42 engages(S) with the ratchet 41, the neck support portion of the strap 30, together with the support portions 21, may be inserted into the housing 10.

Because the support portions 21 are inserted into the housing 10, an injury to the neck may be prevented in the event of a vehicle accident or sudden braking of the vehicle.

For example, in the event of a vehicle accident or sudden braking of the vehicle, the neck of the occupant seated in the vehicle seat may be injured by colliding with the withdrawn support portions 21.

In contrast, according to the present invention, the support portions 21 are inserted into the housing, when the occupant does not desire neck stretching, such that a neck injury caused by the withdrawal of the support portions 21 may be prevented.

Next, the neck stretching of the occupant seated in the vehicle seat according to the present invention will be described.

Figure 4:
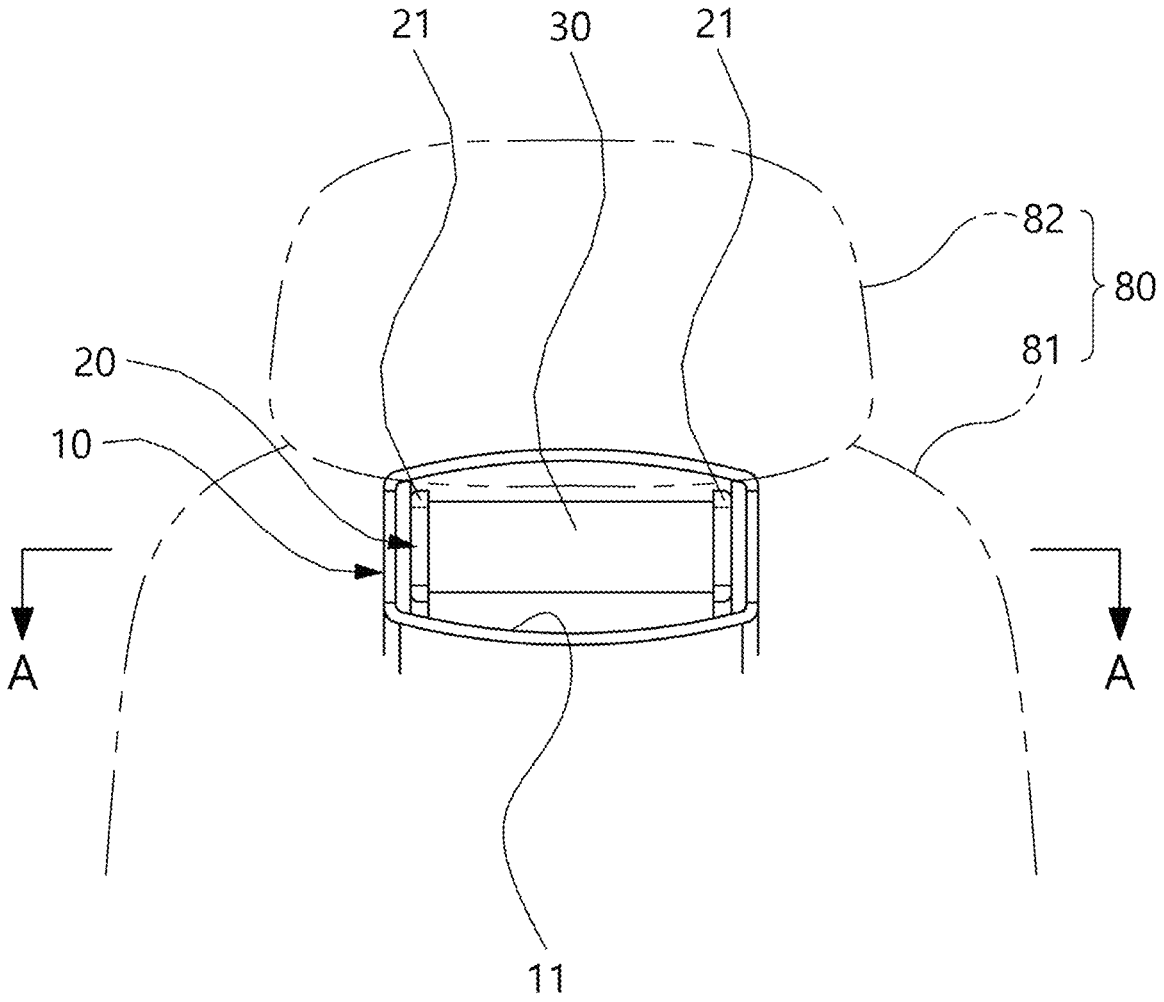
FIG. 4 is a front view illustrating a state in which the neck supporting device according to the exemplary embodiment of the present invention is mounted on a seat.
Figure 5:
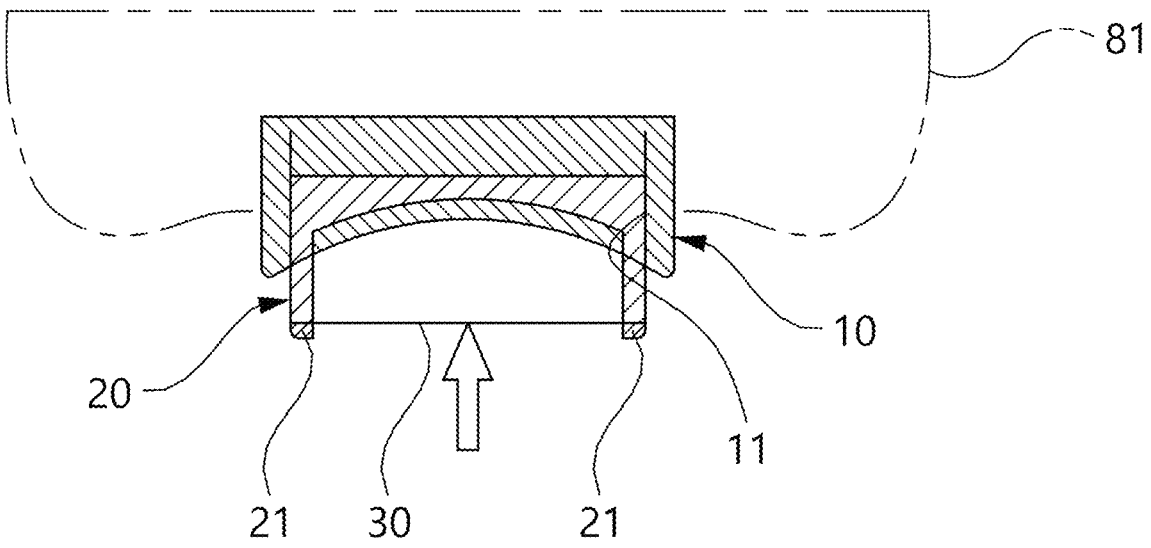
FIG. 5 is a cross-sectional view taken along line A-A in FIG. 4.
Figure 6:
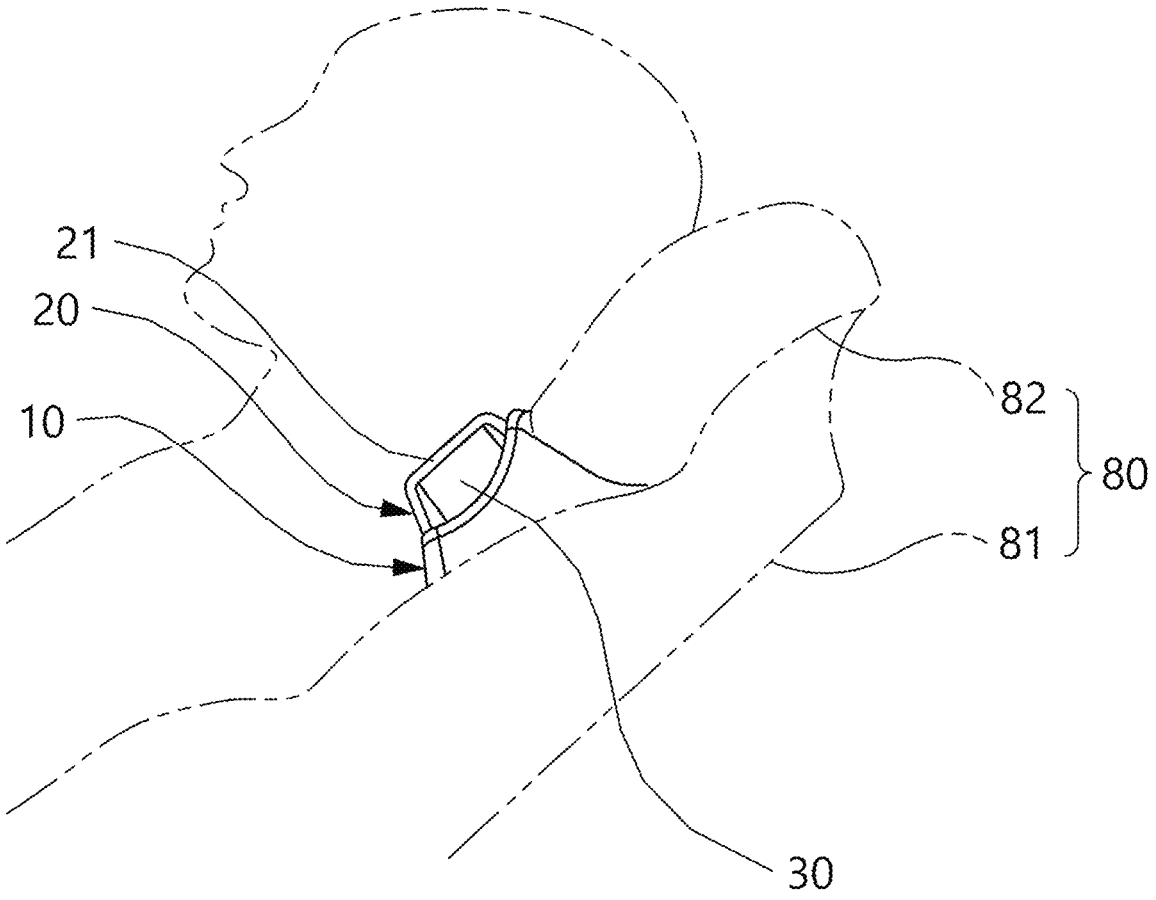
FIG. 6 is a side view illustrating a state in which the neck supporting device according to the exemplary embodiment of the present invention is mounted on the seat.

FIG. 4 is a front view illustrating a state in which the neck supporting device according to the exemplary embodiment of the present invention is mounted on a seat, FIG. 5 is a cross-sectional view taken along line A-A in FIG. 4, and FIG. 6 is a side view illustrating a state in which the neck supporting device according to the exemplary embodiment of the present invention is mounted on the seat.

As illustrated in FIGS. 4 and 5, when the neck supporting device is mounted on the seat 80 and the main body 20 is pulled in the withdrawal direction, the neck support portion of the strap 30, together with the support portions 21, is withdrawn through the opening portion 11 from the inside of the housing 10.

As illustrated in FIG. 6, the backseat 81 of the vehicle seat 80 is inclined in a relaxation state in the state in which the neck support portion of the strap 30 is withdrawn.

When the occupant is seated in the vehicle seat 80 in the state in which the backseat 81 is inclined in the relaxation state, the neck part may come into contact with the withdrawn neck support portion of the strap 30, such that the cervical vertebrae may be stretched.

The stretching of the cervical vertebrae of the occupant seated in the vehicle seat may relieve the fatigue of the occupant seated in the vehicle seat and provide comfort to the occupant seated in the vehicle seat.

As described above, the neck supporting device of the present invention may be attached to the neck part of the vehicle seat and support the neck of the occupant seated in the vehicle seat. In addition, the neck supporting device of the present invention may stably support the neck part, thereby maximizing seat performance. In addition, according to the present invention, the neck of the occupant seated in the vehicle seat may come into contact with the neck support portion of the strap, such that the cervical vertebrae may be naturally stretched. In addition, the neck supporting device of the present invention may support the neck part, thereby preventing the neck from being instantaneously bent rearward in the direction of a vehicle accident or sudden braking of the vehicle, thereby preventing an injury to the cervical vertebrae.

The above description is simply given for illustratively describing the technical spirit of the present invention, and those skilled in the art to which the present invention pertains will appreciate that various modifications, changes, and substitutions are possible without departing from the essential characteristic of the present invention. Accordingly, the embodiments disclosed in the present invention and the accompanying drawings are intended not to limit but to describe the technical spirit of the present invention, and the scope of the technical spirit of the present invention is not limited by the embodiments and the accompanying drawings. The protective scope of the present invention should be construed based on the following claims, and all the technical spirit in the equivalent scope thereto should be construed as falling within the scope of the present invention.

As described above, the exemplary embodiments have been described and illustrated in the drawings and the specification. The exemplary embodiments were chosen and described in order to explain certain principles of the invention and their practical application, to thereby enable others skilled in the art to make and utilize various exemplary embodiments of the present invention, as well as various alternatives and modifications thereof. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A neck supporting device comprising:

a housing capable of being attached to or detached from a seat;

a main body capable of being withdrawn from an inside of the housing, the main body comprising two support portions disposed at two opposite sides of one surface of the main body, respectively, the two support portions being configured to protrude toward a neck of an occupant; and a strap coupled to the two support portions of the main body to have tension, wherein the strap has a neck support portion between the two support portions, the neck support portion being configured to support the neck of the occupant, wherein the housing has one surface having an opening portion through which the neck support portion of the strap and the two support portions are withdrawn together, wherein a width of the opening portion is greater than a distance between the two support portions.

2. The neck supporting device of claim 1, wherein the housing has another surface configured to face the seat.

3. The neck supporting device of claim 1, wherein the strap penetrates side surfaces of the two support portions.

4. The neck supporting device of claim 2, wherein a withdrawal device is disposed on another surface of the main body, and wherein the neck support portion of the strap, together with the two support portions of the main body, is configured to be withdrawn through the opening portion from the inside of the housing by a withdrawal operation of the withdrawal device.

5. The neck supporting device of claim 4, wherein the withdrawal device comprises:

a ratchet connected to the main body and fixed to the housing; and a stopper having one end facing the ratchet and configured to engage with the ratchet.

6. The neck supporting device of claim 5, wherein the stopper is connected to a connection member, and the connection member is connected to the main body.

7. The neck supporting device of claim 6, wherein the connection member is connected to the ratchet by a hinge shaft, wherein an upper portion of the connection member is inserted into the ratchet, such that the connection member is rotatable about the hinge shaft.

8. The neck supporting device of claim 7, wherein the stopper is connected to the connection member by an elastic member.

9. The neck supporting device of claim 8, wherein the elastic member has a spring.

10. A neck supporting device comprising:

a housing capable of being attached to or detached from a seat;

a main body capable of being withdrawn from an inside of the housing, the main body comprising two support portions disposed at two opposite sides of one surface of the main body, respectively, the two support portions being configured to protrude toward a neck of an occupant; and a strap coupled to the two support portions of the main body to have tension, wherein the strap has a neck support portion between the two support portions, the neck support portion being configured to support the neck of the occupant, wherein the housing has one surface having an opening portion configured to have the neck support portion of the strap and the two support portions withdrawn together therethrough, wherein a withdrawal device is disposed on another surface of the main body, and wherein the neck support portion of the strap, together with the two support portions of the main body, is configured to be withdrawn through the opening portion from the inside of the housing by a withdrawal operation of the withdrawal device, wherein the withdrawal device comprises:

a ratchet connected to the main body and fixed to the housing; and a stopper having one end facing the ratchet and configured to engage with the ratchet, wherein the stopper is connected to a connection member, and the connection member is connected to the main body, wherein the connection member is connected to the ratchet by a hinge shaft, wherein an upper portion of the connection member is inserted into the ratchet, such that the connection member is rotatable about the hinge shaft.

11. A neck supporting device comprising:

a housing capable of being attached to or detached from a seat;

a main body capable of being withdrawn from an inside of the housing, the main body comprising two support portions disposed at two opposite sides of one surface of the main body, respectively, the two support portions being configured to protrude toward a neck of an occupant; and a strap coupled to the two support portions of the main body to have tension, wherein the strap has a neck support portion between the two support portions, the neck support portion being configured to support the neck of the occupant, wherein the housing has one surface having an opening portion through which the neck support portion of the strap and the two support portions are withdrawn together, wherein the two support portions are configured to be withdrawn from the inside of the housing through the opening portion by a rotating motion of the main body within the housing.

* * * * *